United States Patent [19]

Cusumano

[11] Patent Number: 4,524,704

[45] Date of Patent: Jun. 25, 1985

[54] ACCESSORY-HOLDING JIG PROVIDING MULTIPLE SEWING POSITIONS

[75] Inventor: Salvatore V. Cusumano, Moscow, Pa.

[73] Assignee: G & G Sewing Machine Co., Inc., Moscow, Pa.

[21] Appl. No.: 486,799

[22] Filed: Apr. 20, 1983

[51] Int. Cl.[3] ..... D05B 3/18

[52] U.S. Cl. ..... 112/105

[58] Field of Search ..... 112/104, 105, 107, 108, 112/109, 110, 111, 12, 153; 403/328

[56] References Cited

U.S. PATENT DOCUMENTS

| | | | |
|---|---|---|---|
| 855,286 | 5/1907 | Dantzig et al. | 112/153 |
| 1,269,413 | 6/1918 | Finnigan | 403/328 X |
| 1,605,385 | 11/1926 | Bebel | 112/105 |
| 2,142,277 | 1/1939 | McDonald | 112/153 |
| 2,932,047 | 4/1960 | Johnston | 403/328 X |
| 3,123,032 | 3/1964 | Gehringer | 112/107 |
| 3,143,092 | 8/1964 | Glassman et al. | 112/105 |
| 3,393,886 | 7/1968 | Glassman | 248/16 |
| 3,415,210 | 12/1968 | Glassman | 112/114 |
| 4,363,280 | 12/1982 | Lindquist | 112/105 |

FOREIGN PATENT DOCUMENTS 644171 10/1950 United Kingdom .

*Primary Examiner*—Werner H. Schroeder
*Assistant Examiner*—Andrew M. Falik
*Attorney, Agent, or Firm*—John Kurucz

[57] ABSTRACT

A jig for holding an accessory to be stitched to fabric relative to the needle of a sewing machine comprises a first captive sliding bar and an accessory holder attached to the sliding bar. There are at least two stop positions located, as by detents, on the first sliding bar which correspond in spacing to the spacing in one direction to two sets of thread holes in the accessory. The jig may include a second sliding bar between the first sliding bar and the accessory holder to furnish movement transverse to that of the first sliding bar and stop positions related to the positions in a transverse direction of thread holes in the accessory. Different accessory holders may attach to the end of the sliding bar to hold different accessories, such as skirt hooks or eyes.

7 Claims, 3 Drawing Figures

ACCESSORY-HOLDING JIG PROVIDING MULTIPLE SEWING POSITIONS

BACKGROUND AND SUMMARY OF THE INVENTION

This invention relates generally to sewing-machine jigs for holding accessories while they are being sewn and, more specifically, to jigs for holding skirt hooks or skirt eyes during the process of sewing them onto fabric.

Previous jigs for holding wire accessories, such as belt hooks and eyes, while they are being sewn onto fabric, are not adapted for sewing skirt hooks and eyes, which are stamped from sheet metal. Accessories that are made from sheet metal are more massive and generally have thread holes that are considerably smaller than the holes in the previously-used wire accessories. These holes are arranged in sets of one or more holes with the sets of holes being remote and precisely positioned from each other. A typical skirt eye, for instance, is a dumbbell-shaped piece of sheet metal with the eye formed by the bar that is in a slightly different plane from the wider end portions. A pair of small thread holes is located in each of the wider end portions of the skirt eye. A typical skirt hook is also made from sheet metal and is formed by folding to yield two layers. The upper layer is tongue shaped and the lower layer has three thread-hole-sets in an approximately semicircular arrangement. A pair of small thread holes is located on earlike extensions near each end of the fold, and a single elongated thread hole comprising the third hole-set is located on a third extension midway between the others on the arc of the semicircle. This three-point configuration gives the skirt hook the required stability to prevent the end of the hook from lifting away from the fabric when the skirt hook is interlocked with the skirt eye while on a garment.

In prior jigs, the position of the jig is under the control of the sewing machine and requires the machine to be set up and maintained for a single type accessory. It is desirable to provide a jig whose position can be under the control of the operator.

The novel jig holds an accessory during machine sewing and permits convenient and rapid repositioning of such accessory to several different predetermined positions under operator control. These predetermined sewing positions correspond to the exact locations of the thread-hole sets on the accessory and, therefore, the accessory can be sewn to the fabric at more than one attachment point with only one insertion of the accessory into the jig.

The novel jig comprises a first captive sliding bar and an accessory holder attached to the sliding bar. There are at least two stop positions, which may be detents on the first sliding bar, which detents correspond in spacing to the spacing in one direction between the three-hole sets in the accessory. The jig may include a second captive sliding bar between the first sliding bar and the accessory holder, to furnish motion transverse to the motion in the first sliding bar and stop positions related to the positions in another orthogonal direction between the thread-hole sets on the accessory. Each of the first and second sliding bars may have a means attached thereto for manually imparting sliding motion thereto.

DETAILED DESCRIPTION OF THE INVENTION

Button sewing fixtures are typically attached to industrial sewing machines by means of an arm-type holder extending parallel to the sewing machine arm, but below the machine arm and between it and the sewing plate. It is to this auxiliary arm that the present jig is attached. In a first embodiment of the invention, the novel jig is attached to such an auxiliary arm which terminates as a narrow flat bar. The novel jig is attached to the underside of the auxiliary arm by screws which pass through holes in the auxiliary arm and into threaded holes in the attachment plate of the novel jig.

The attachment plate of the novel jig contains a rectangular groove, oriented in the direction parallel to the auxiliary arm, for the entire length of the underside of the attachment plate. A rectangular-cross-section bar fits into the groove with sliding clearance and is held in place by a holding plate. The holding plate, which contains a matching groove, is held onto the attachment plate by machine screws in threaded holes. An accessory holder is attached to the end of the sliding bar which extends beyond the grooves. An actuating lever is attached to the underside of the jig and, when actuated manually, electrically or pneumatically, can move the sliding bar forward and backward by action upon a pin extending from the sliding bar and riding in a slot in the holding plate. A spring-loaded ball held in the holding plate by a thread insertion arrangement rides on a path on the sliding bar which includes either two or three depressions to act as detents to the bar movement and furnish specific repeatable locations. The novel jig therefore permits convenient motion parallel to the orientation of the sewing machine arm with several specific repeatable predetermined work positions.

A second similar sliding-bar arrangement may be attached between the end of the first sliding bar and the accessory holder to provide a second set of predetermined work positions transversely offset from the first set of locations to permit the stitching of accessories which contain thread holes not oriented in a straight line. This second sliding bar arrangement includes a second actuating lever for moving the second sliding bar manually, electrically or pneumatically.

The accessory holder, usually an "L" shaped bracket with provision to hold the skirt hook or skirt eye, is attached to either the first or second sliding bar to complete the system. This accessory holding fixture has a vertical section which attaches to the jig and a horizontal section into which the accessory to be stitched is inserted and held horizontally, parallel to the fabric.

The entire system therefore furnishes a means for precisely aligning the thread holes in accessories with respect to the needle of the sewing machine quickly and accurately under the control of the machine operator to enable attachment of such accessories as skirt hooks and eyes at normal production speeds.

Figure 1:
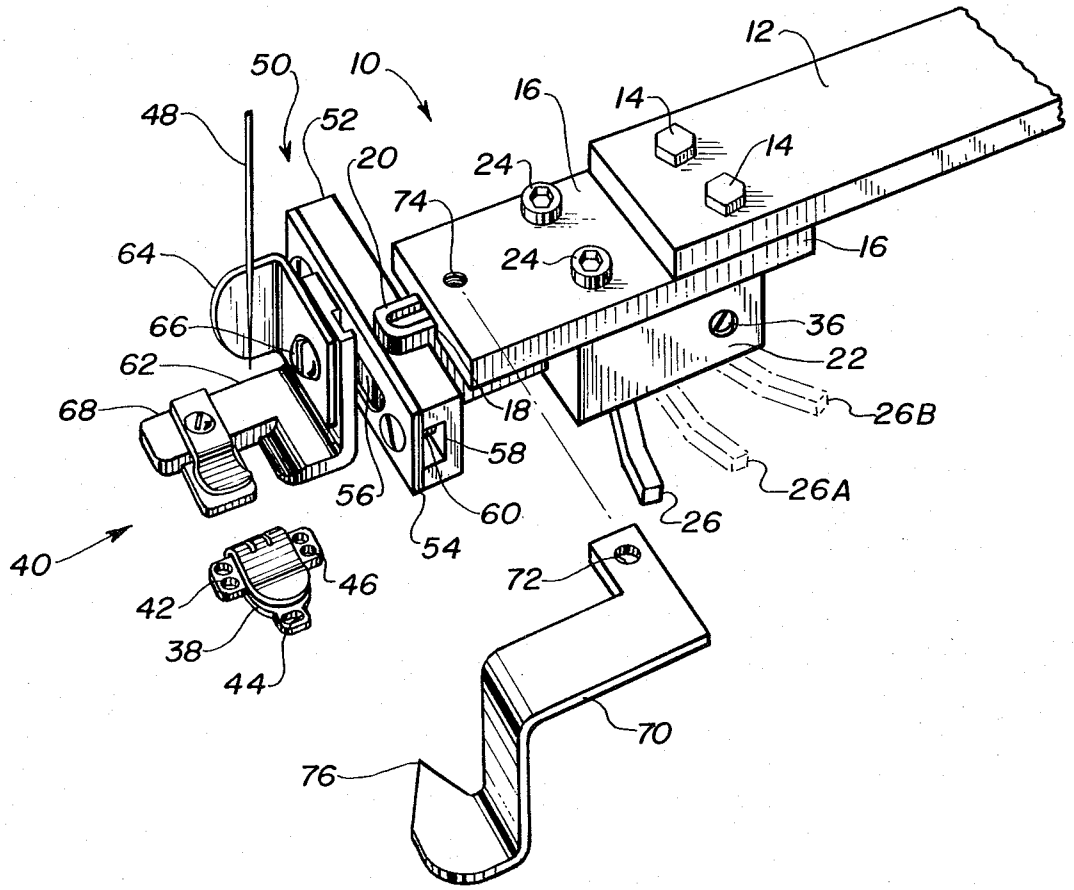
FIG. 1 is a perspective view of a first embodiment of the invention with a skirt-hook-holding fixture.

FIG. 1 shows the first embodiment of the novel jig 10 attached to an auxiliary arm 12 by screws 14 which are inserted in threaded holes (not shown) in a jig attachment plate 16. The attachment plate 16 has a first groove 18 located on the underside of the attachment plate 16 and is oriented parallel to the direction of the auxiliary arm 12, which is itself mounted in a fixed relation with respect to the sewing needle 48, parallel to the sewing machine arm (not shown) and between the sewing machine arm and the sewing surface (not shown).

A sliding bar 20 is located within the first groove 18 with clearance appropriate for sliding in a direction perpendicular to the movement of the workpiece over the serving plate as the skirt hook is being stitched thereto and is held within the first groove 18 by holding plate 22 which has a complementary second groove (not shown) to the first groove 18. The holding plate 22 is held in place below the attachment plate 16 by screws 24, thus, in combination with the attachment plate 16, capturing the sliding bar 20, but permitting linear movement controlled by a lever 26.

Figure 3:
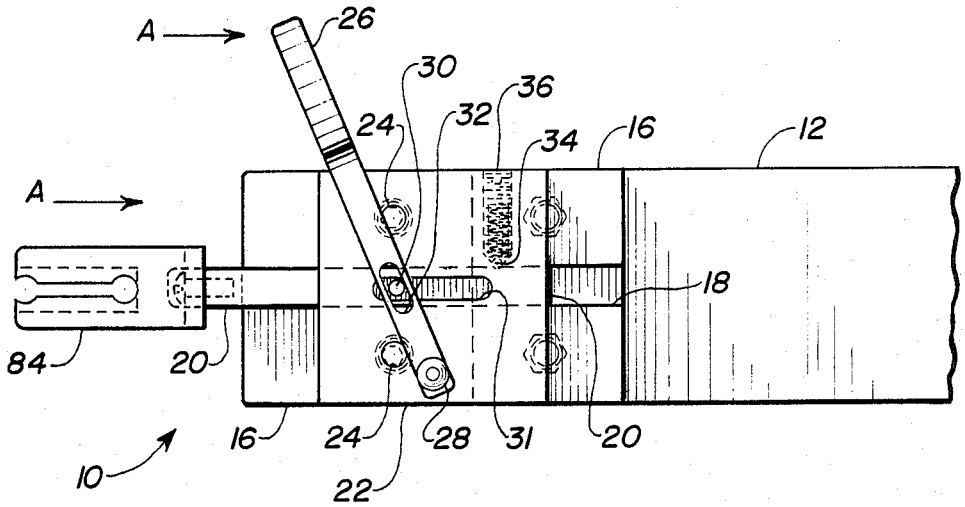
FIG. 3 is a partial bottom view of the second embodiment showing the lever action of the first sliding bar.

As can be seen in FIG. 3 which is a bottom view of the second embodiment of the novel jig, but includes the same parts described above, the lever 26 pivots on a pivot connection 28 and engages a pin 30 with a slot 32. Pin 30 is connected to the underside of the sliding bar 20, and moves within a slot 31 cut on the underside of the holding plate 22, thereby moving the sliding bar 20 toward the auxiliary arm 12 when the lever 26 is moved in direction A. Spring-loaded ball 34, which is held in the holding plate 22 by a threaded insert 36, rides upon a path on the side surface of the sliding bar 20, which has at least two circular depressions (not shown) or detents to determine specific locations of rest for the sliding bar 20 in its movement.

Three rest positions 26, 26A and 26B are required for the embodiment of FIG. 1 as described below, while two rest positions are required for the embodiment of FIG. 2 and FIG. 3. In all cases the location of the rest positions is determined by the linear displacement (in direction A) between the various sets of thread holes in the accessories to be stitched onto the fabric.

Referring once more to FIG. 1, such an accessory, a skirt hook 38, is shown separated from the jig 10 but adjacent to accessory-holding clamp 40. Skirt hook 38 has three sets of thread holes 42, 44, and 46. Since these sets of thread holes have three linear locations in direction A, lever arm also has three specific locations 26, 26A and 26B determined by the detents in the holding plate 22 and the insert 36. However, as is apparent from the configuration of skirt hook 38, a transverse movement is also required to align thread-hole set 44 with the needle 48 if the needle 48 was previously aligned with either thread-hole-set 42 or thread-hole-set 46. This transverse motion is provided by a fixture 50 which is attached between the end of sliding bar 20 and the accessory holding clamp 40. Fixture 50 is constructed with a grooved base 52 and cover 54 retaining a second sliding bar 56 within a groove 58. Screw 60 and a similar screw at the opposite end of groove 58 act as positive stops at the end of the movement of second sliding bar 56. Accessory holding fixture 62 and tab 64 are attached to second slide bar 56 by means of screw 66, and accessory holding clamp 40 is attached to the horizontal leg 68 of the accessory holding fixture 62. Skirt hook 38 may be inserted into accessory holding clamp 40 in a predetermined position where it is retained by spring pressure.

Marker arm 70, shown detached from the jig 10 to permit a better view of the construction details, is attached to the attachment plate 16 by alignment of a hole 72 on marker arm 70 with a threaded hole 74 on the attachment plate 16 and clamping them with a screw (not shown) inserted into a hole 74.

Marker arm 70 is then used to accurately align one set of holes on skirt hook 38 with the point 76 and the needle 48, thus assuring that subsequent movements of the jig 10 will result in alignment of the other two sets of holes. For instance, the positions in which lever 26 and tab 64 are pictured indicate that three-hole set 46 would be aligned with needle 48 and point 76. Thus, movement of the lever 26 to position 26A and the tab 64 fully forward until the screw 60 stops the second sliding bar 56, puts the thread-hole-pair 44 in alignment with the needle 48. Likewise, movement of the lever 26 to a position 26B and the return of tab 64 to the location pictured aligns thread holes 42 with needle 48.

Figure 2:
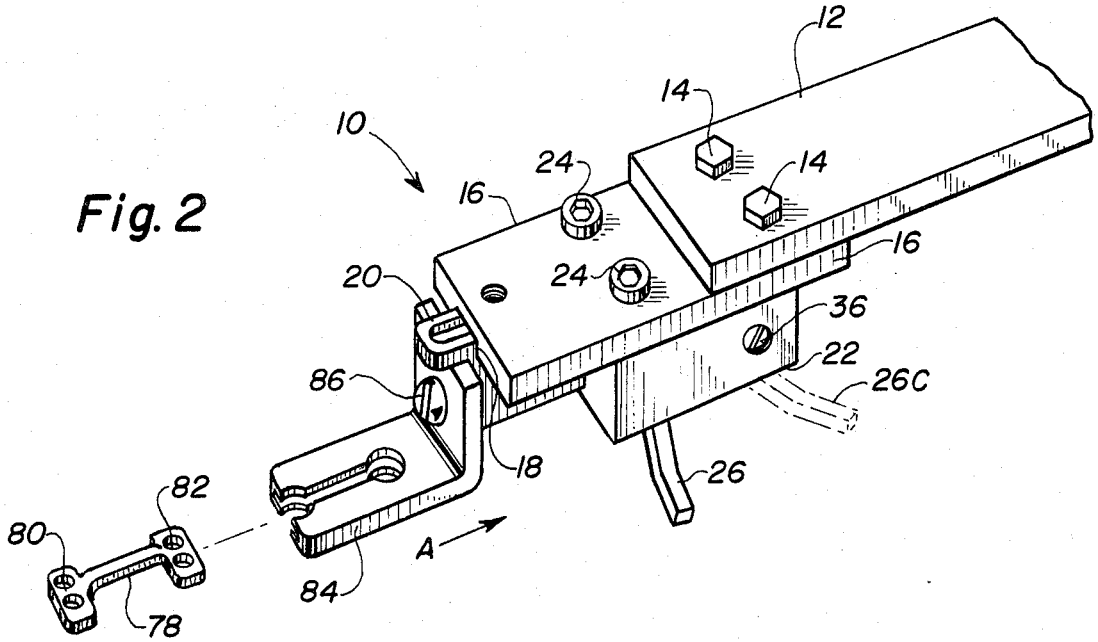
FIG. 2 is a perspective view of a second embodiment of the invention with a skirt-eye-holding fixture.

The second embodiment of the novel jig shown in FIGS. 2 and 3 operates in the same manner as the first embodiment of FIG. 1 except that, because a skirt eye 78 has only two sets of thread holes, 80 and 82, which can be oriented in a line, the transverse motion is not required and only two linear positions are used. For this embodiment, accessory-holding fixture 84, designed to accommodate skirt eye 78, is attached directly to the end of sliding bar 20 by a screw 86 and also no marker arm is required. The location of the lever 26 at a position 26C is then determined by new indentations or detents on the side of sliding bar 20, which are engaged by the spring-loaded detent ball 34 (FIG. 3), and are located to correspond to the distance between thread-hole sets 80 and 82 on skirt eye 78.

The two embodiments pictured therefore permit exact alignment of the thread holes on various accessories with the sewing machine needle and also permit rapid and accurate realignment of multiple sets of thread holes relative to each other.

It is to be understood that the form of the invention as shown is merely preferred embodiments. Various changes may be made in the function and arrangement of parts; equivalent means may be substituted for those illustrated and described; and certain features may be used independently from others without departing from the spirit and scope of the invention as defined in the following claims.

For instance, wire or sheet metal accessories may be held during stitching, and accessories with other shapes could be used with the present invention by simply using appropriately designed holding fixtures. Moreover, several detents could be used with second sliding bar 56 to yield more than two transverse positions for the jig and more detents could be added to the first sliding bar 20 to permit the stitching of many more sets of thread holes in the linear direction. An entire matrix of thread-hole sets can be determined by the combination of multiple positions of both sliding bars. Also, instead of manual positioning of the sliding bars, each sliding bar could be power driven; for example, electrically as with a solenoid, or pneumatically as with an air-driven piston.

What is claimed is:

1. A jig for a sewing machine, in combination with a clothing fastening accessory having at least two thread holes, wherein said jig supports said accessory while being stitched to a workpiece comprising:

attachment means attachable to the sewing machine in predetermined relationship with respect to the needle of the sewing machine;

a first sliding means held in slidable relationship with the attachment means and including first location-determining means to impede the first sliding means in at least two predetermined positions, said two positions being separated by the same distance in one direction as two thread holes on said accessory wherein said distance is substantially parallel to the sewing machine needle plate and substantially perpendicular to the direction of workpiece travel when said accessory is being stitched thereto;

an accessory-holding means attached to and extending from the first sliding means to a location below the needle of the sewing machine, permitting the alignment of the at least two thread holes on the accessory with the needle of the sewing machine when the first slidable means is in its predetermined positions.

2. The jig defined in claim 1 wherein said first location-determining means is a spring-loaded ball held against a surface of the slidable means and said surface of the slidable means has means therein in the path which contacts the ball for impeding the first sliding means.

3. The jig defined in claim 1 wherein the first sliding means includes a lever attached to the first sliding means and extending away from the first sliding means for imparting motion to the first sliding means.

4. A jig for a sewing machine, in combination with a clothing fastening accessory having at least two thread holes, wherein said jig supports said accessory while being stitched to a workpiece comprising:

attachment means attachable to the sewing machine in predetermined relationship with respect to the needle of the sewing machine;

a first sliding means held in slidable relationship with the attachment means and including first location-determining means to impede the first sliding means in at least two predetermined positions, said two positions being separated by the same distance in one direction as two thread holes on said accessory wherein said distance is substantially parallel to the sewing machine needle plate and substantially perpendicular to the direction of workpiece travel when said accessory is being stitched thereto;

an accessory-holding means attached to and extending from the first sliding means to a location below the needle of the sewing machine, permitting the alignment of at least two thread holes on the accessory with the needle of the sewing machine when the first slidable means is in its predetermined positions; and a second sliding means between said first sliding means and said accessory-holding means, said second sliding means being slidable in a direction that is transverse to the sliding motion of said first sliding means, and including second location-determining means to impede the second sliding means in at least two predetermined positions, said positions being separated by the same distances in said transverse direction as two thread holes on said accessory.

5. The jig defined in claim 4 wherein the second location-determining means has two stops at both ends of the motion of the second sliding means.

6. The jig defined in claim 2 wherein the second sliding means includes a thumb tab attached to the second sliding means for imparting motion to the second sliding means.

7. A jig for a sewing machine, in combination with a clothing fastening accessory having at least two thread holes, wherein said jig supports said accessory while being stitched to a workpiece comprising:

attachment means attachable to the sewing machine in predetermined relationship with respect to the needle of the sewing machine;

a first sliding means held in a slidable relationship with the attachment means and including first location-determining means to impede the first sliding means in at least two predetermined positions, said two positions being separated by the same distance in one direction as two thread holes on said accessory;

an accessory-holding means attached to and extending from the first sliding means to a location below the needle of the sewing machine, permitting the alignment of the at least two thread holes on the accessory with the needle of the sewing machine when the first slidable means is in its predetermined positions; and a marker means to aid in the alignment of the thread-holes on the accessory with respect to the needle of said sewing machine, said marker being rigidly attached to the attachment means and including an indicator means permanently aligned with the location of the sewing-machine needle.

* * * * *